US010993500B2

(12) United States Patent
Wardle

(10) Patent No.: US 10,993,500 B2
(45) Date of Patent: May 4, 2021

(54) SPORTING FOOTWEAR

(71) Applicant: MASAU PTY LTD, Northmead (AU)

(72) Inventor: Gavin Wardle, Northmead (AU)

(73) Assignee: MASAU PTY LTD, Northmead (AU)

( * ) Notice: Subject to any disclaimer, the term of this patent is extended or adjusted under 35 U.S.C. 154(b) by 0 days.

(21) Appl. No.: 15/781,426

(22) PCT Filed: Dec. 5, 2016

(86) PCT No.: PCT/AU2016/051197

§ 371 (c)(1),
(2) Date: Jun. 4, 2018

(87) PCT Pub. No.: WO2017/091871

PCT Pub. Date: Jun. 8, 2017

(65) Prior Publication Data

US 2018/0352902 A1 Dec. 13, 2018

(30) Foreign Application Priority Data

Dec. 3, 2015 (AU) ..... 2015905017

(51) Int. Cl.

| | |
|---|---|
| ***A43C 15/16*** | (2006.01) |
| ***A43B 13/26*** | (2006.01) |
| ***A43B 13/14*** | (2006.01) |
| ***A43B 13/18*** | (2006.01) |
| ***A43B 5/06*** | (2006.01) |
| ***A43B 5/02*** | (2006.01) |

(52) U.S. Cl.

CPC ..... *A43B 13/141* (2013.01); *A43B 5/02* (2013.01); *A43B 5/06* (2013.01); *A43B 13/181* (2013.01); *A43B 13/26* (2013.01); *A43C 15/162* (2013.01); *A43C 15/167* (2013.01); *A43C 15/168* (2013.01)

(58) Field of Classification Search

CPC ... A43C 15/162; A43C 15/167; A43C 15/168; A43B 13/141; A43B 13/26; A43B 5/02; A43B 5/06; A43B 13/181

See application file for complete search history.

(56) References Cited

U.S. PATENT DOCUMENTS

| | | | | | |
|---|---|---|---|---|---|
| 2,582,053 | A * | 1/1952 | Merlin | A43D 100/14 | 36/59 R |
| 3,577,663 | A * | 5/1971 | Mershon | A43C 15/162 | 36/67 D |
| 4,546,559 | A | 10/1985 | Dassler | | |
| 4,559,724 | A * | 12/1985 | Norton | A43B 5/06 | 36/114 |
| 5,829,172 | A * | 11/1998 | Kaneko | A43B 5/06 | 36/108 |

(Continued)

FOREIGN PATENT DOCUMENTS

EP 1234516 A1 8/2002

OTHER PUBLICATIONS

International Search Report and Written Opinion (International Application No. PCT/AU2016/051197); dated Feb. 27, 2017.

*Primary Examiner* — Ted Kavanaugh
(74) *Attorney, Agent, or Firm* — Howard & Howard Attorneys PLLC

(57) ABSTRACT

A sporting footwear having a front sole (21) and heel (23) with the sole having a primary frictional support (30) and the heel having a secondary frictional support (25) which has substantially less frictional support than the primary frictional support.

17 Claims, 12 Drawing Sheets

(56) References Cited

U.S. PATENT DOCUMENTS

| | | | | |
|---|---|---|---|---|
| 2005/0155254 | A1* | 7/2005 | Smith | A43B 13/181 36/28 |
| 2013/0047465 | A1 | 2/2013 | Auger et al. | |
| 2014/0202042 | A1 | 7/2014 | Berend et al. | |
| 2015/0181977 | A1 | 7/2015 | Klug et al. | |
| 2016/0000180 | A1* | 1/2016 | Cook | A43B 5/06 36/103 |

* cited by examiner

SPORTING FOOTWEAR

CROSS-REFERENCE TO RELATED APPLICATIONS

This application is a National Phase of International Patent Application No. PCT/AU2016/051197, filed Dec. 5, 2016, which claims priority to Australian Patent Application No. 2015905017, filed Dec. 3, 2015, the disclosures of which are hereby incorporated by reference in their entirety.

FIELD OF THE INVENTION

The present invention relates to sporting footwear and in particular to football boots.

The invention has been developed primarily for use in playing football in one or more of various codes whether soccer, Australian Rules, Rugby or Grid Iron and will be described hereinafter with reference to this application. However, it will be appreciated that the invention is not limited to this particular field of use.

BACKGROUND OF THE INVENTION

Sporting footwear generally is dependent on the purpose and the surface upon which it is to be used. The surfaces can be categorized into three groups being:

An indoor or outdoor flat sport surface such as a stadium floor having smooth even wooden, concrete, carpet or rubber for basketball, indoor cricket, volleyball, table tennis, squash and a range of other indoor sports, ball sports such as tennis; This type of surface needs flat soled shoes that allow grip.

A natural or synthetic grass playing field having a length and substantial give. This type of surface requires protruding stops in order to stop the slide of the person as the ground gives way. This has seen the entire undersurface of the footwear covered by stops to prevent this slippage.

A penetrable natural or synthetic surface such as a running track or a turf cricket pitch. This type of surface requires a long sharp metal spike that penetrates the surface and is arranged to provide substantially forward only motion in an action/reaction approach.

It can be seen therefore that sporting footwear comprises:

i) flat soles;

ii) football or outdoor boots having stops over the entire sole and heel to provide an anti-slip or friction control system; and iii) sharp spikes located to penetrate specialist surfaces and provide substantially forward only progress.

In sports nowadays, there is a substantial difference in playing football or the like than from 20 years ago. In particular there is a lot more running, but there is a lot more deviation running, rather than merely to run in forward directions, with substantial lateral deviations to provide a path through circuitous or crowded pack or scrum locations requiring quick and effective change of directions. If normal football boots with stops all over the underneath is used then there is little chance of changing direction and a substantial increased risk of damaged feet, ankles, hamstrings or knees.

However such known sports footwear systems do not provide sufficient support and control such that there is provided for use on a natural or synthetic grass playing field a sporting wear that allows any one or more of the following:

Controlled lateral motion;

Ready change of direction;

Allowability for pivotability;

Control in more than a directly forward direction.

There has been progression from using hard spikes in golf shoes to what is referred to as "soft spikes" that are softer compression plastic friction elements rather than long sharp metal spikes. This is so the grip is still there but that penetration and wear and tear on the golf course fairways and greens are minimised. However still the idea is to provide stability when teeing off or playing fairway shots and therefore the soft spikes are located evenly all over a substantially flat continuous planar sole and heel that includes the soft spikes in a general even pattern throughout.

However still there is not shown an approach in sports footwear that allows ready movement in directions other than directly forward.

The present invention seeks to provide sporting footwear, which will overcome or substantially ameliorate at least one or more of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE INVENTION

According to an aspect of the present invention, sporting footwear is provided by requiring a primary front sole frictional support.

It can be seen that the invention of sporting footwear provides the benefit of allowing improved mobility while still retaining grip.

The invention also provides a sporting footwear having a sole and heel with the sole having a primary frictional support and the heel having a secondary frictional support which has substantially less frictional support than the primary frictional support.

According to a further aspect of the present invention, sporting footwear is provided by a football boot having improved primary front foot support with improved longitudinal and lateral control such that only front of foot is primarily ground engaging to provide frictional control.

It can be seen that the invention of sporting footwear provides the benefit of lateral movement.

Preferably the sporting footwear comprises a football boot having improved primary front foot support with improved longitudinal and lateral control such that only front of foot is primarily ground engaging to provide frictional control.

The football boot can have an improved pivot front foot support with improved longitudinal and lateral control such that only front of foot is primarily ground engaging to provide frictional control.

A sporting footwear wherein the improved pivot front foot support includes stops on the front sole and wherein the improved footwear includes no stops or substantial protrusions on the rear sole relative to the front sole.

The improved pivot front foot support can be integral with the front or be attachable to the front sole.

In one form a football boot can have the improved pivot front foot support formed integral with the front sole by a moulded sole integral with moulded stops.

In another form the football boot can have a front sole plate with a plurality of sockets each for receiving a protrudable stop providing the primary front frictional support sole.

Preferably the sporting footwear has at least some of the plurality of sockets each for receiving a protrudable stop form substantially opposing lines near lateral edges of the sole plate.

A majority of the plurality of sockets each for receiving a protrudable stop can be located at the rear of the front sole plate form substantially opposing lines near lateral edges of the sole plate.

At least one of the plurality of sockets each for receiving a protrudable stop can be locatable in a central position of the front sole plate spaced from other stops to form a rotating pivot point.

Preferably the football boot has rear heel design with roll or stability characteristics but not with frictional characteristics such that only front of foot is primarily ground engaging to provide frictional control while rear of boot is aiding correct movement laterally or longitudinally.

The heel can be a moulded continuous heel. Preferably the heel has little or no protrusions.

Preferably the boot is flexible to angle the heel relative to the front sole.

The invention can provide a sporting footwear being a football boot which requires only a primary front sole frictional support by use of stops or the like.

According to one form of the invention there is provided a sporting footwear having a sole and heel with the sole having a primary frictional support and the heel having a secondary frictional support which has substantially less frictional support than the primary frictional support, stops and cleats projecting from the sole and heel of the footwear, wherein the stops are only on the sole forming part of the primary frictional support and not on the heel having a secondary frictional support; and wherein the cleats are smaller projections than the stops; and the sole having the primary frictional support at an angle to the heel such that only front of foot is primarily ground engaging to provide frictional control.

The cleats are generally shaped projections having a leading front and a broader rear wherein the cleats are generally a triangular prismatic shaped projections having a leading front and a broader rear with inward leaning rear and side faces.

The cleats are generally a triangular prismatic shaped projections having a leading front and a broader rear with inward leaning rear and side faces; the cleats are generally arranged on the front sole to have the broader rear of the shaped projections facing forward on the footwear so as to aid stopping actions by the primary frictional support, and the cleats are generally arranged on the rear heel to have the narrower front of the shaped projections facing forward on the footwear so as to aid frontwards sliding motion by the secondary frictional support.

The inward leaning rear and side faces are shaped and located on the sole or heel such that the outer leaning wall leans less inwardly than the inner leaning wall; and the inward leaning rear and side faces are shaped and located on the sole or heel such that if the cleat is centrally located on the sole or heel the outer leaning wall leans substantially equally to the inner leaning wall.

In light of the above the sporting footwear can be substantially assembled with improving structure including any one or more of the following:

i. Improvements in structure and assembly including construction in order to minimise slippage when running on the front sole;
ii. Improvements in controlled lateral motion and ready change of direction;
iii. Improvements in allowability for pivoting on the front sole;
iv. Control in more than a directly forward direction
v. Adjustability of design of front, rear and lateral slip or anti-slip to suit a user and sport;
vi. Simpler structure;
vii. Ability to be integral or receivable of stops;
viii. Ability to weight the footwear forwardly.

It can be seen that the invention of sporting footwear provides the benefit of able to be a modern multitask footwear unlike the prior art.

Other aspects of the invention are also disclosed.

BRIEF DESCRIPTION OF THE DRAWINGS

Notwithstanding any other forms which may fall within the scope of the present invention, a preferred embodiment/preferred embodiments of the invention will now be described, by way of example only, with reference to the accompanying drawings in which.

DESCRIPTION OF PREFERRED EMBODIMENTS

Figure 1:
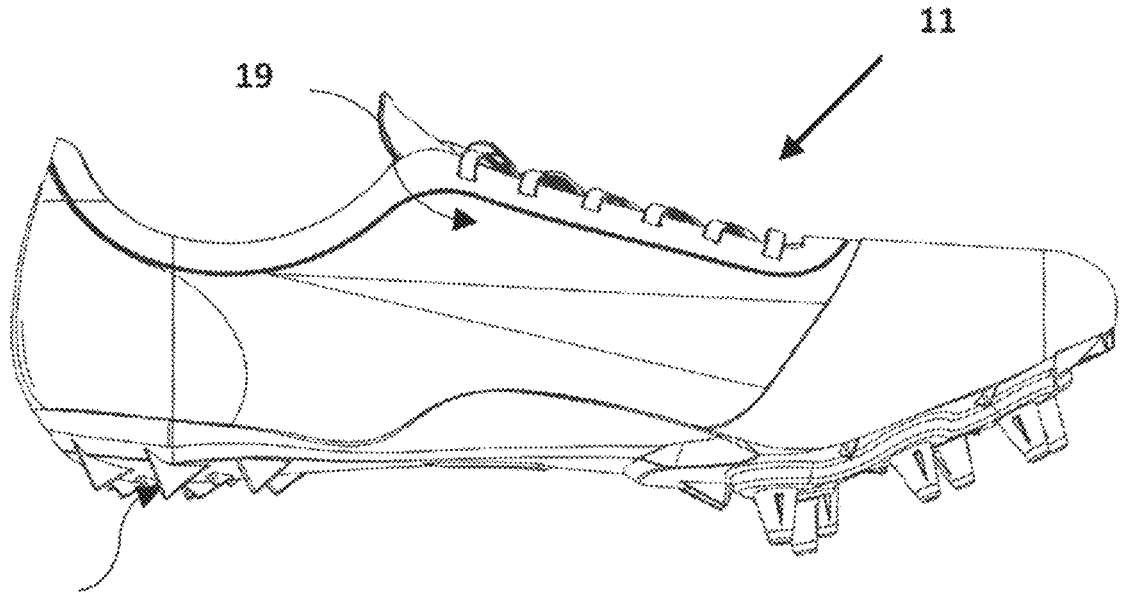
FIG. 1 is a side elevation of a sporting footwear in accordance with a preferred embodiment of the present invention.
Figure 2:
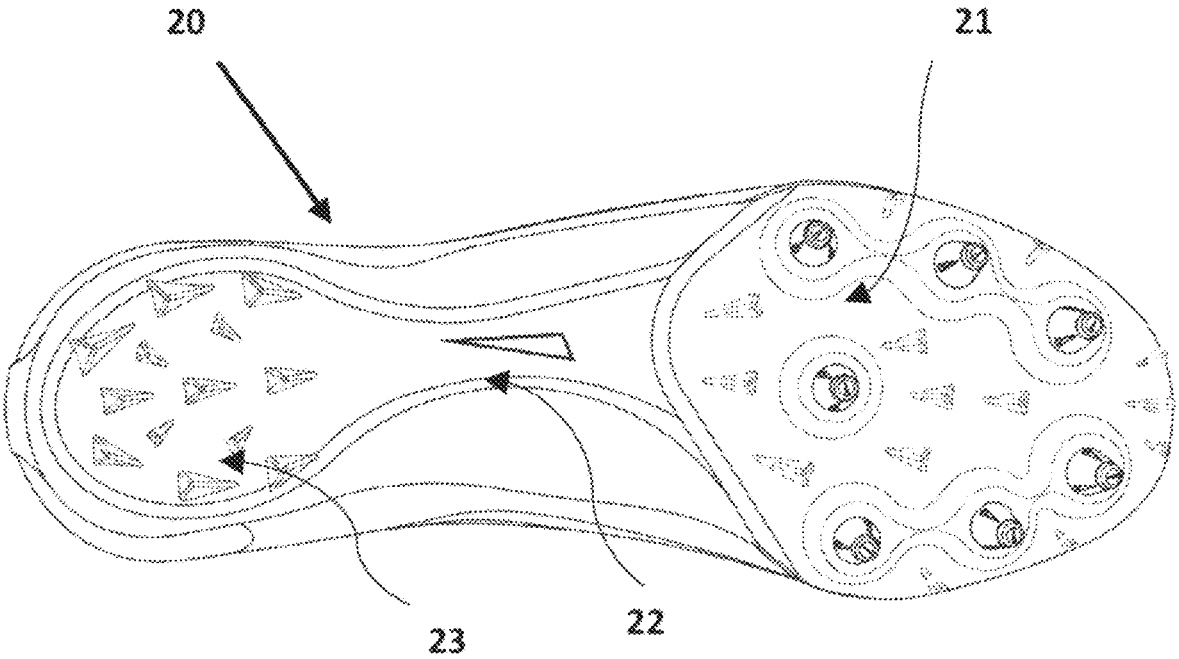
FIG. 2 is an underneath plan view of the sporting footwear of FIG. 1.

It should be noted in the following description that like or the same reference numerals in different embodiments denote the same or similar features.

In one form the invention provides a sporting footwear requiring only a primary front sole frictional support. This can be achieved in which a football boot requiring only a primary front sole frictional support by use of stops or the like.

Referring to FIGS. 1 to 6 there is shown a football boot 11 according to the invention having an upper 19 extending from a toe portion to a heel portion closeable by laces in a top section. In the under surface there is a sole 20 extending from a front sole 21 extending to a middle instep or arch support area 22 to a rear heel section 23.

In this form of the embodiment of the invention the sporting footwear 11 has a front sole 21 and rear heel 23 with the sole having a primary frictional support and the heel having a secondary frictional support which has substantially less frictional support than the primary frictional support.

A plurality of frusto-conical stops 30 and shaped cleats 25 projecting from the sole and heel of the footwear. It is the variation of the number and density of the stops 30 and cleats 25, the relative sizing of the projections on the sole and heel, the shaping of the shaped cleats 25, the relative location of the cleats and the orientation of the cleats that provide a variation of the primary frictional surface of the front sole 21 to the secondary frictional surface of the heel 23.

Figure 3:
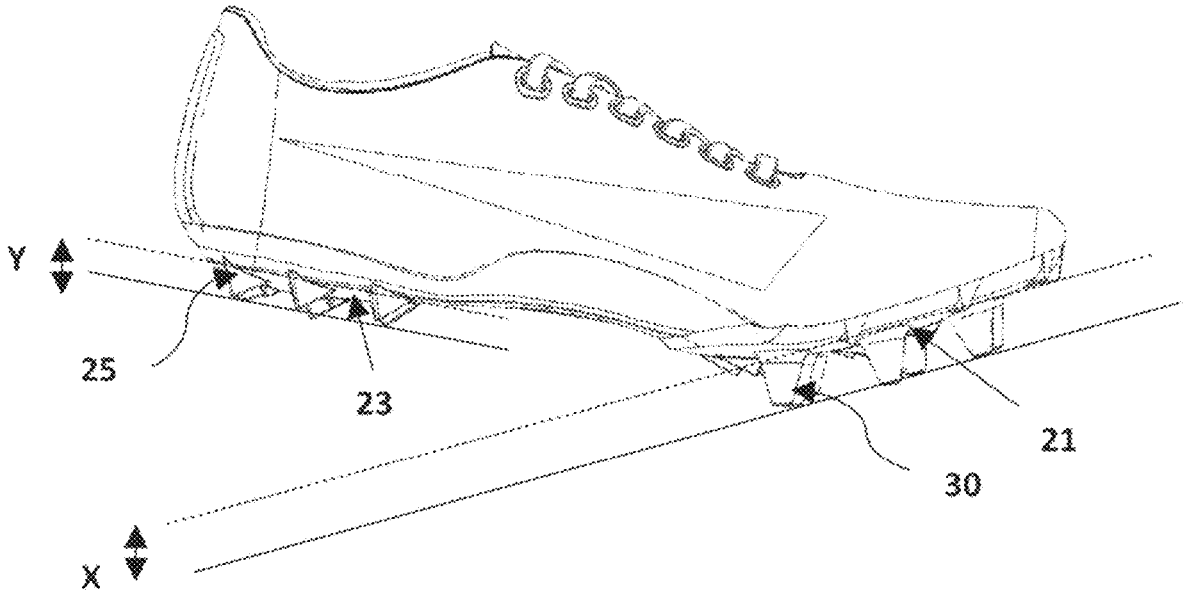
FIG. 3 is a side elevation of the sporting footwear of FIGS. 1 and 2 showing relative sizing of cleats on heel as part of secondary frictional support to stops on front sole as part of primary frictional support.
Figure 4:
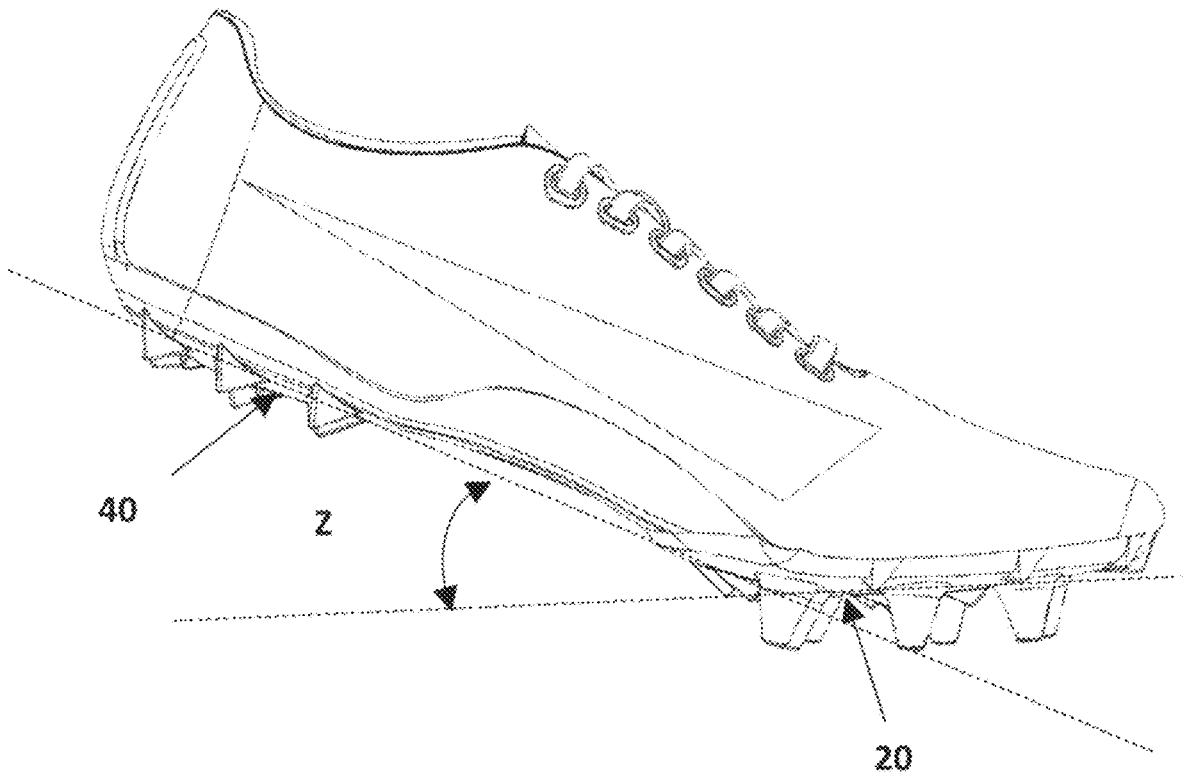
FIG. 4 is a side elevation of the sporting footwear of FIGS. 1 and 2 showing angular variation of front sole to heel planes.

It can be seen in FIG. 3 in this embodiment that the stops are only on the sole forming part of the primary frictional support and not on the heel having the secondary frictional support and the cleats smaller projections than the stops. In particular the cleats Referring to FIG. 4 the front sole has the primary frictional support at an angle Z to the heel such that only the front of foot is primarily ground engaging to provide frictional control.

Figure 5:
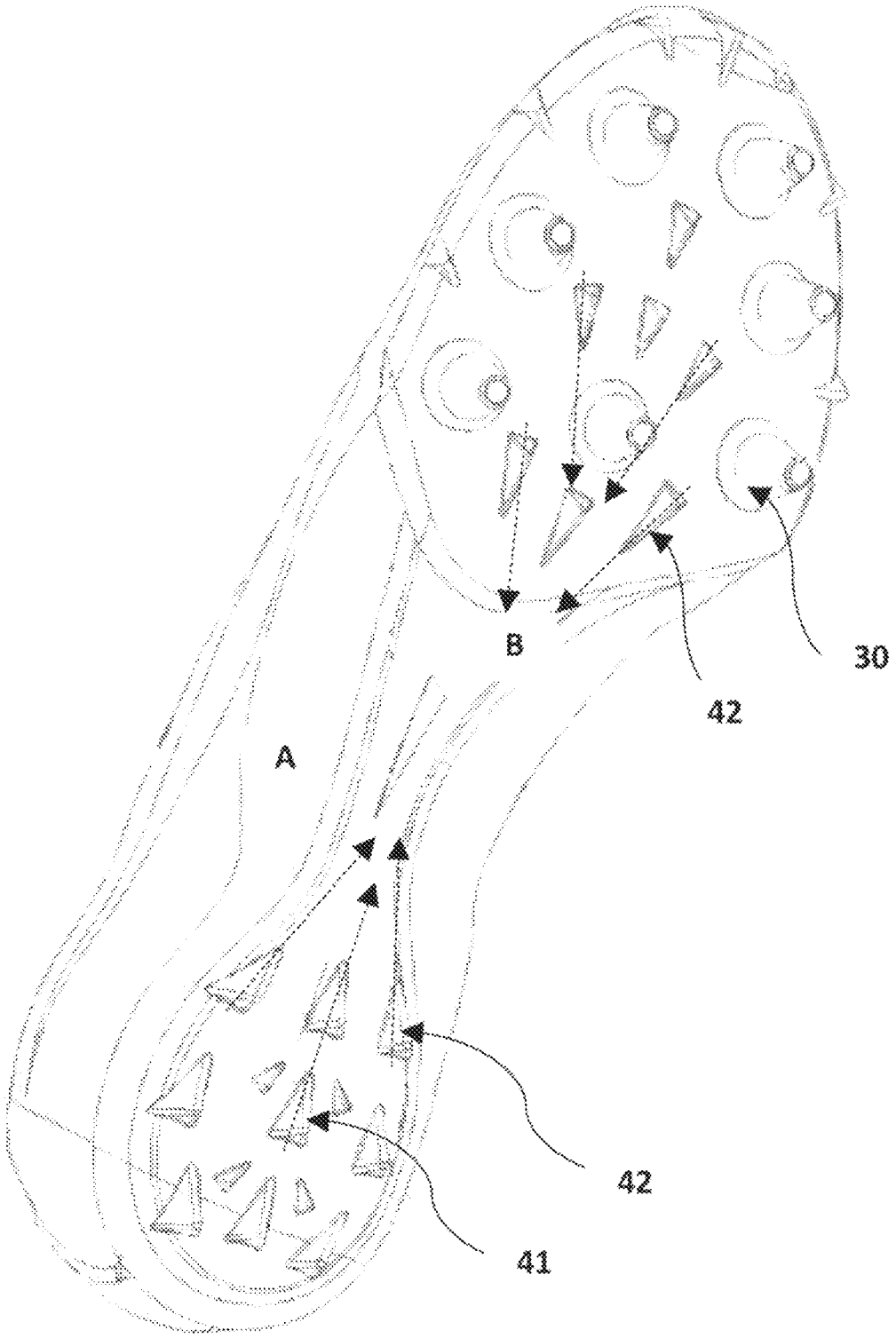
FIG. 5 is an underneath view of the sporting footwear of FIGS. 1 and 2 showing relative directional location of leading narrower front of shaped cleats relative to broader rear when configured on heel as part of secondary frictional support leading forwardly to point or region on instep portion and on front sole as part of primary frictional support leading rearwardly to point or region on instep portion.
Figure 6:
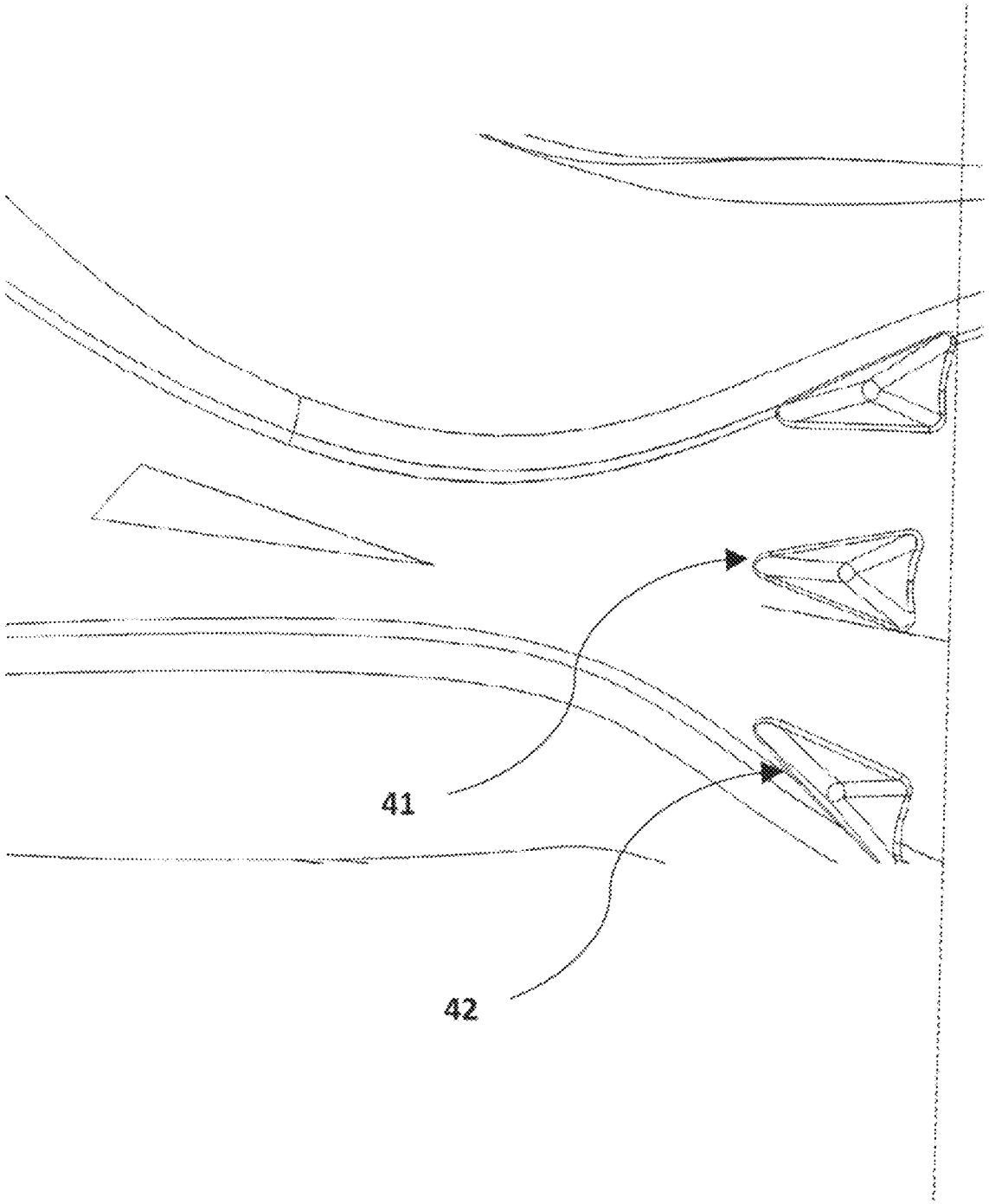
FIG. 6 is a detail of FIG. 5 showing centrally located cleat and side located cleat and the varying structure of the cleat due to their relative position.

Referring to FIGS. 5 and 6 the cleats are generally shaped projections having a leading front and a broader rear. This shaping allows a general sliding direction in line with the leading front while the broader rear is more of an anti-slide aspect in that direction. In this particular embodiment it is particularly favourable to have the cleats generally as a triangular prismatic shaped projections having a leading front and a broader rear with inward leaning rear and side faces. Therefore the cleats in this form of triangular prismatic shaped projections have three substantially planar sides forming a leading front and a broader rear with inward leaning rear and side faces.

The shaping of the cleats changes according to their location on the front sole or heel. If the cleats are generally arranged on the front sole to have the broader rear of the shaped projections facing forward on the footwear so as to aid stopping actions by the primary frictional support. If the cleats are generally arranged on the rear heel to have the narrower front of the shaped projections facing forward on the footwear so as to aid frontwards sliding motion by the secondary frictional support.

Figure 7:
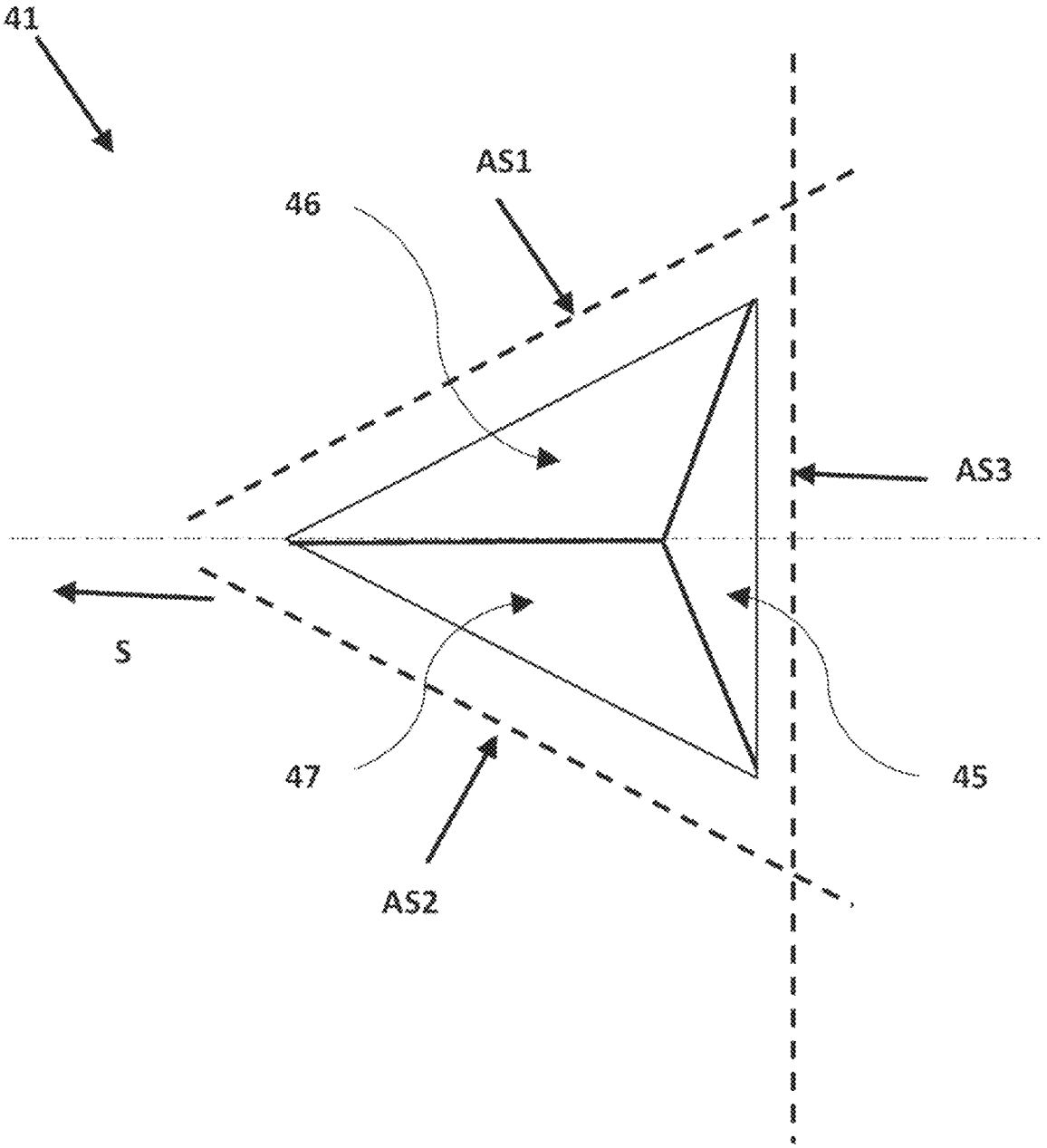
FIGS. 7, 8, 9 and 10 are diagrammatic explanatory views of the variation of the structure of the cleat due to their relative position and requirements for use in the sporting footwear of FIG. 1.

If the cleat 41 is centrally located on the sole or heel the inward leaning rear and side faces are shaped and located on the sole or heel such that the outer leaning wall leans substantially equally to the inner leaning wall as shown in FIG. 7.

Figure 8:
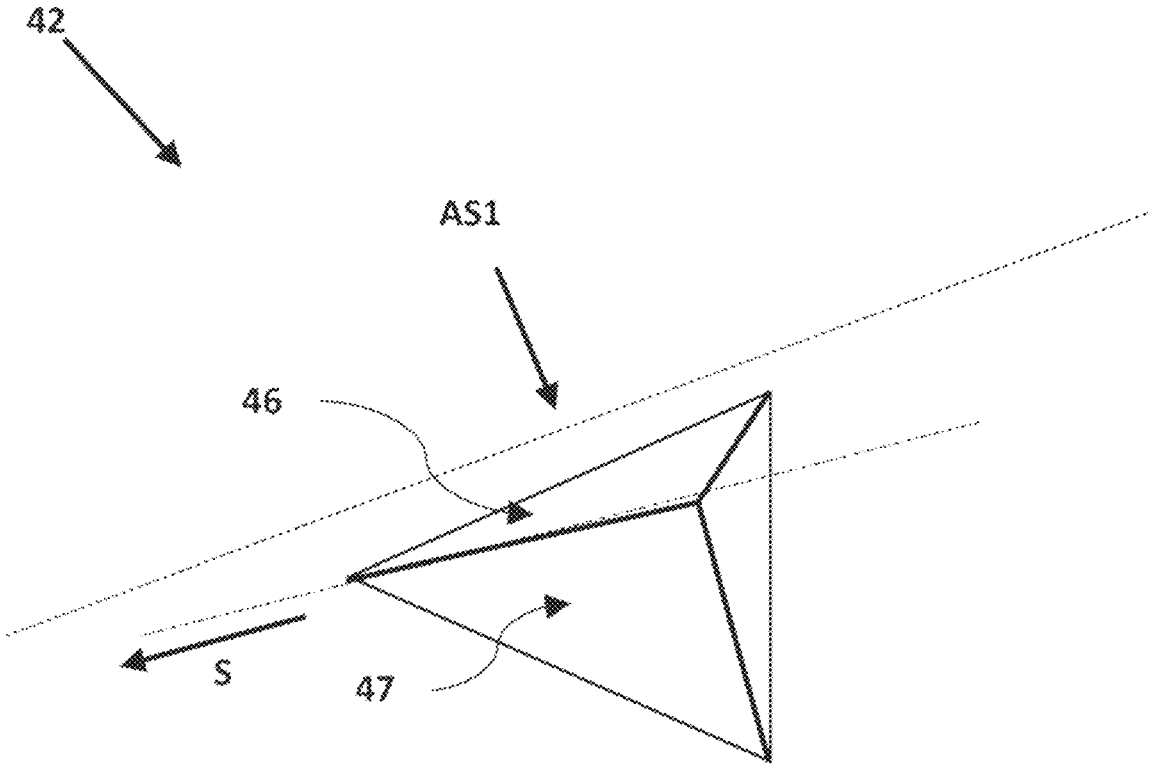
Figure 9:
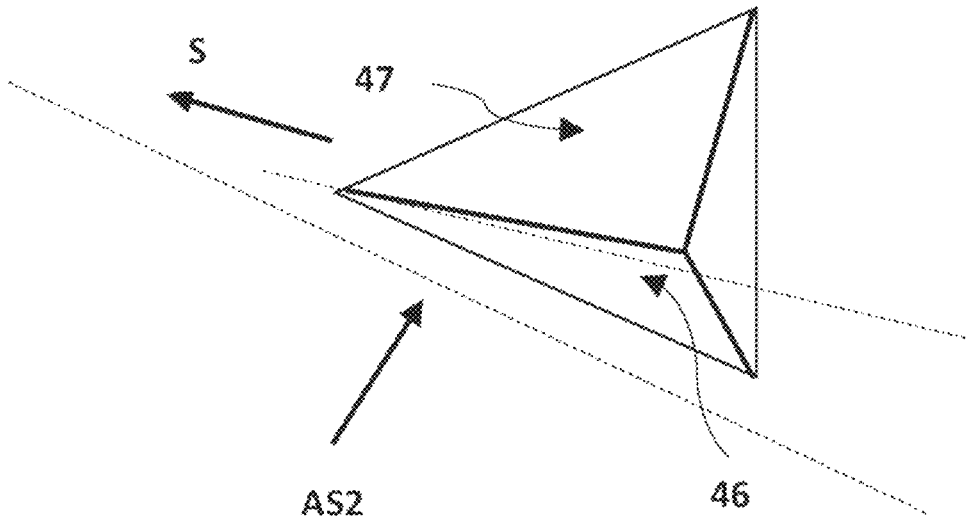

However if the cleat 42 is located on periphery or off-centre on the sole 21 or heel 23, the inward leaning rear and side faces 45, 46 and 47 are shaped and located on the sole or heel such that the outer leaning wall 46 leans less inwardly than the inner leaning wall 47. This provides more of an anti-slide such as shown by AS1 and AS2 in FIGS. 8 and 9.

Figure 10:
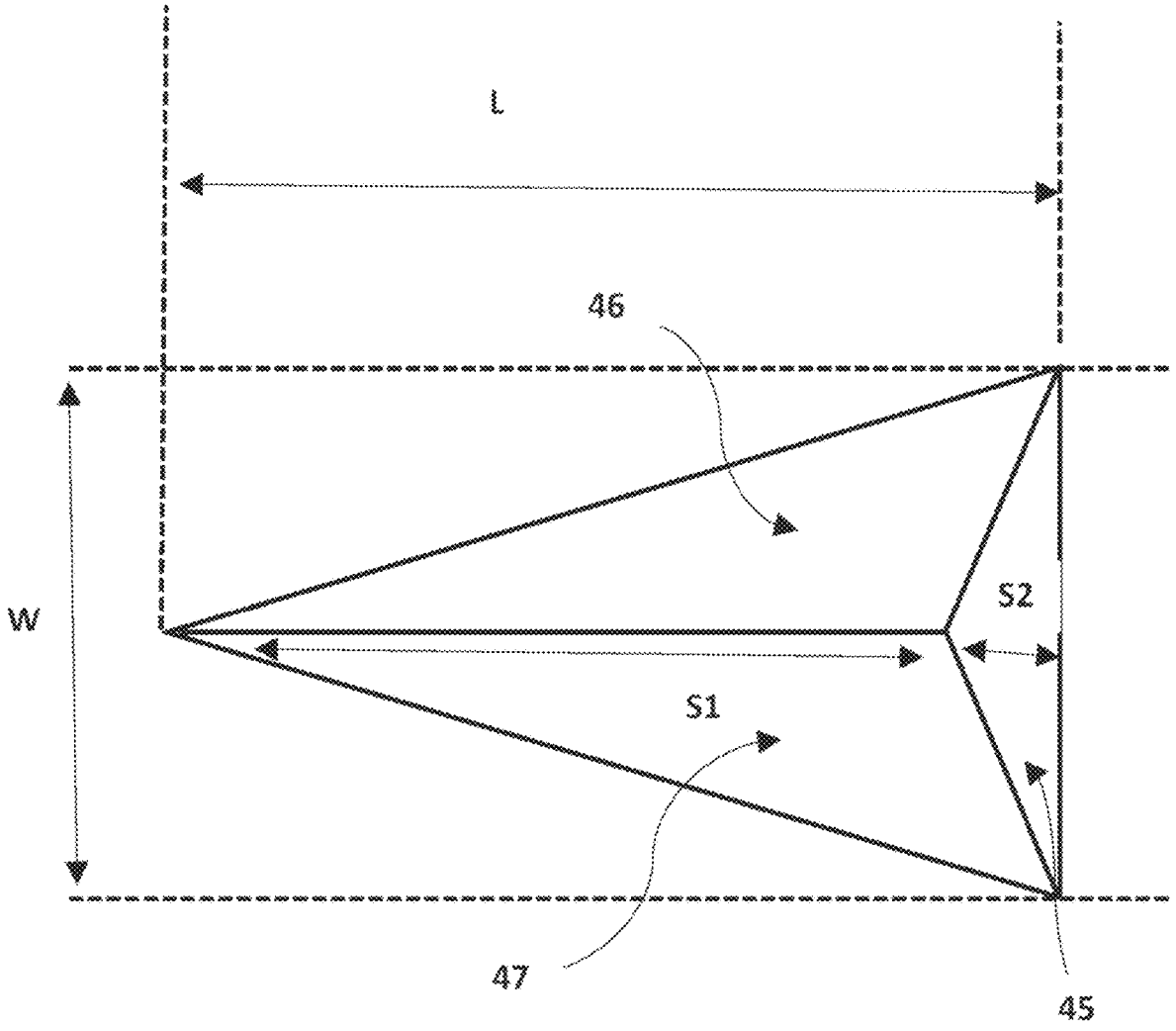
Figure 11:
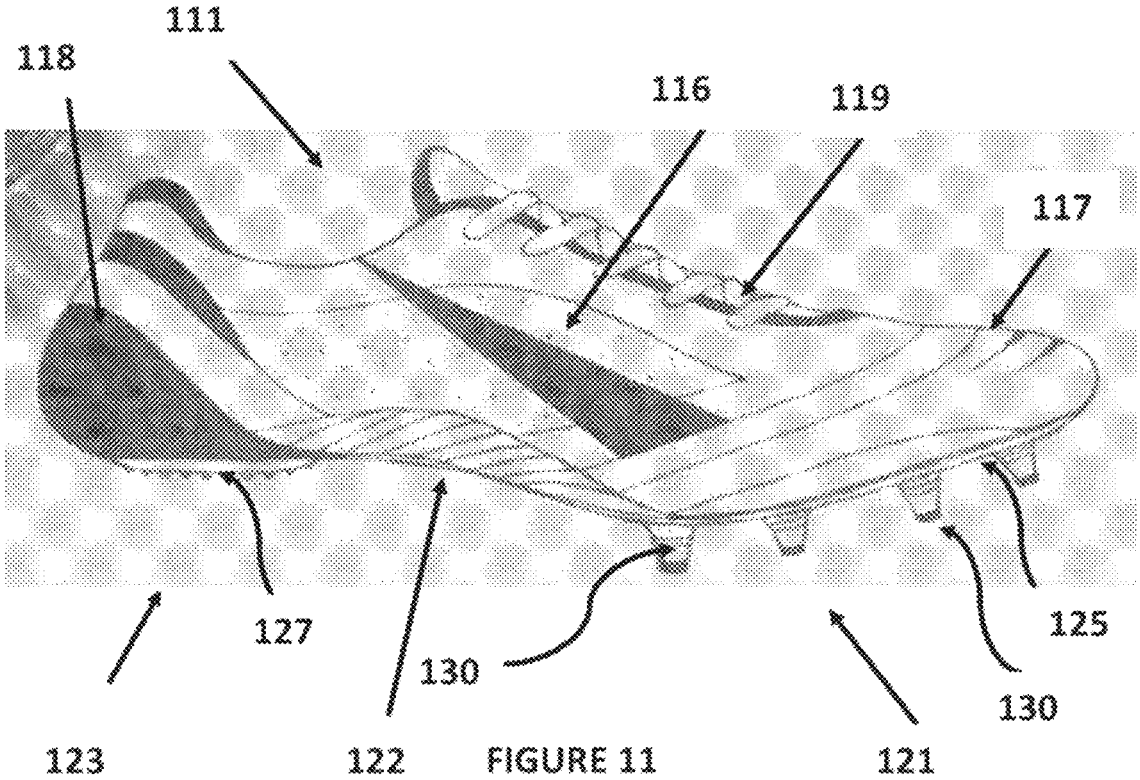
FIG. 11 is a side elevation of a sporting footwear in accordance with a further preferred embodiment of the present invention.
Figure 12:
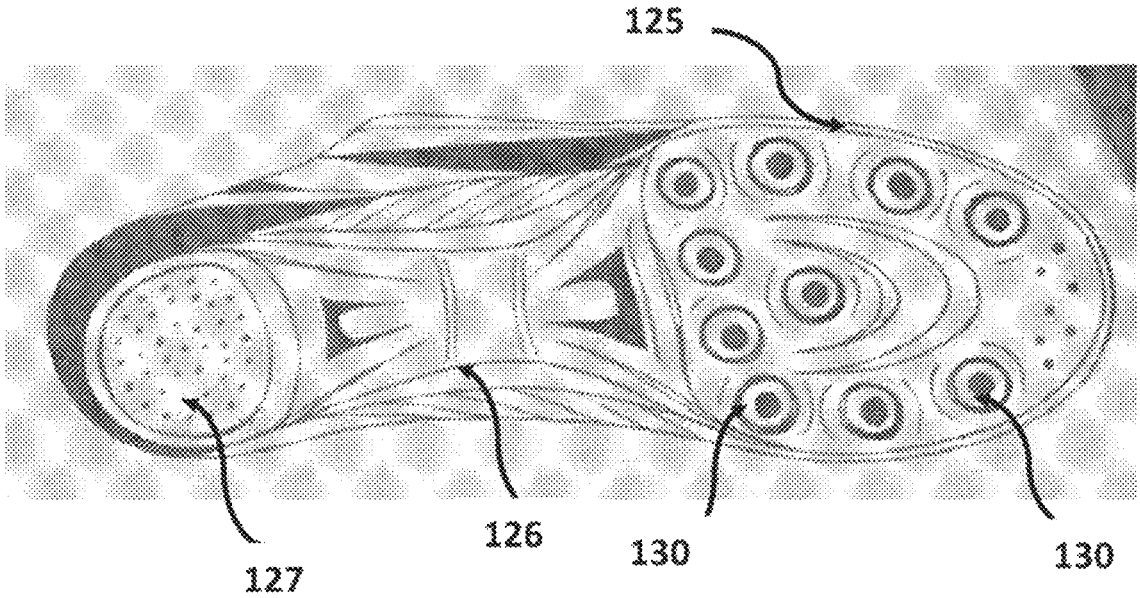
FIG. 12 is an underneath plan view of the sporting footwear of FIG. 11.
Figure 13:
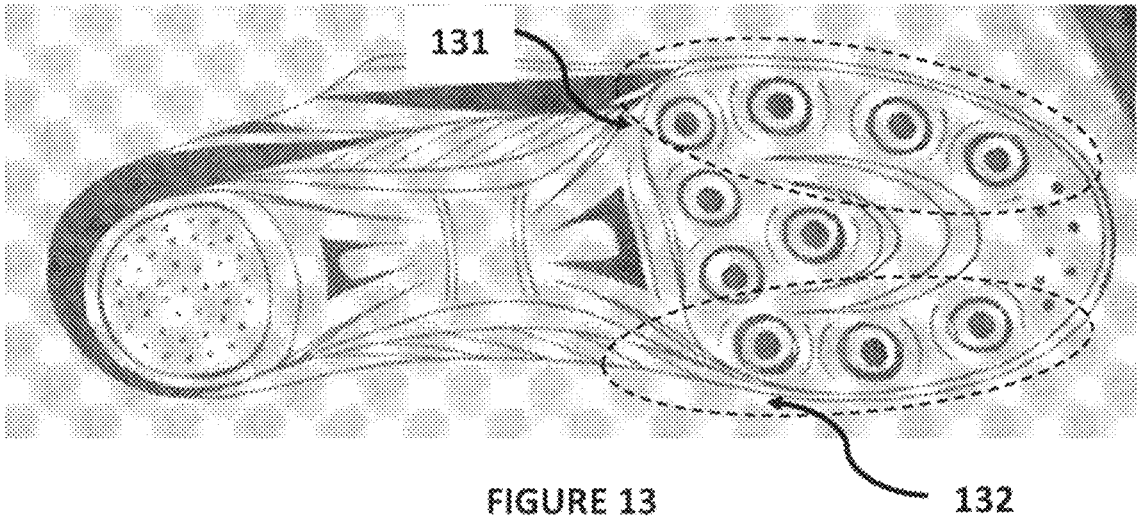
FIGS. 13, 14, and 15 are underneath plan views of the sporting footwear of FIG. 11 showing particular sections of the front sole.
Figure 14:
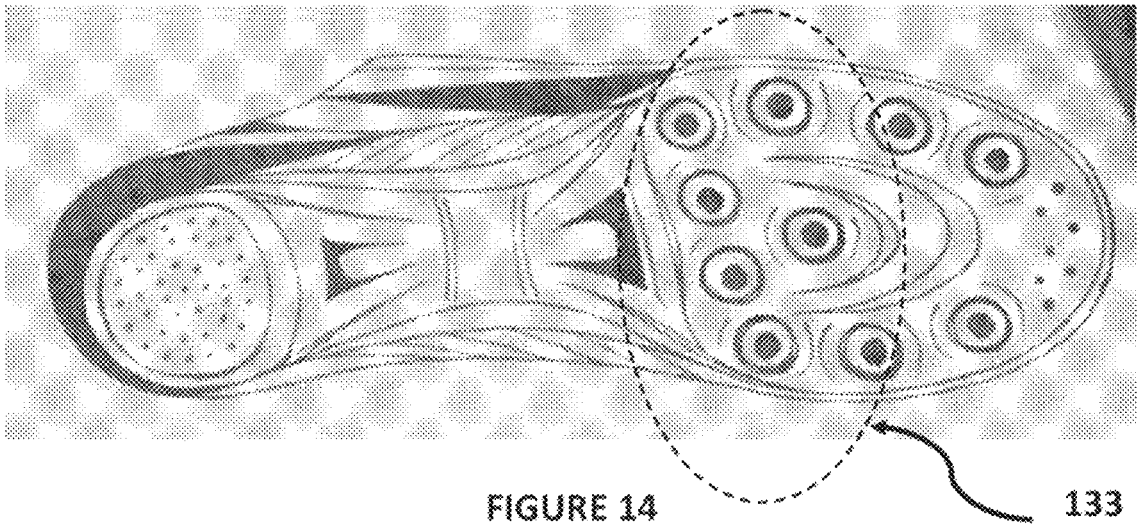
Figure 15:
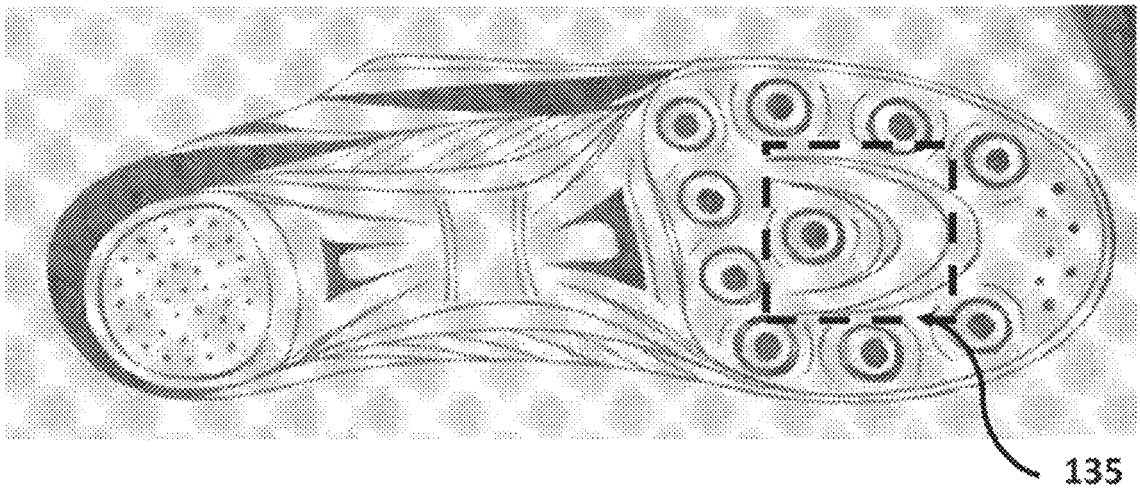
Figure 16:
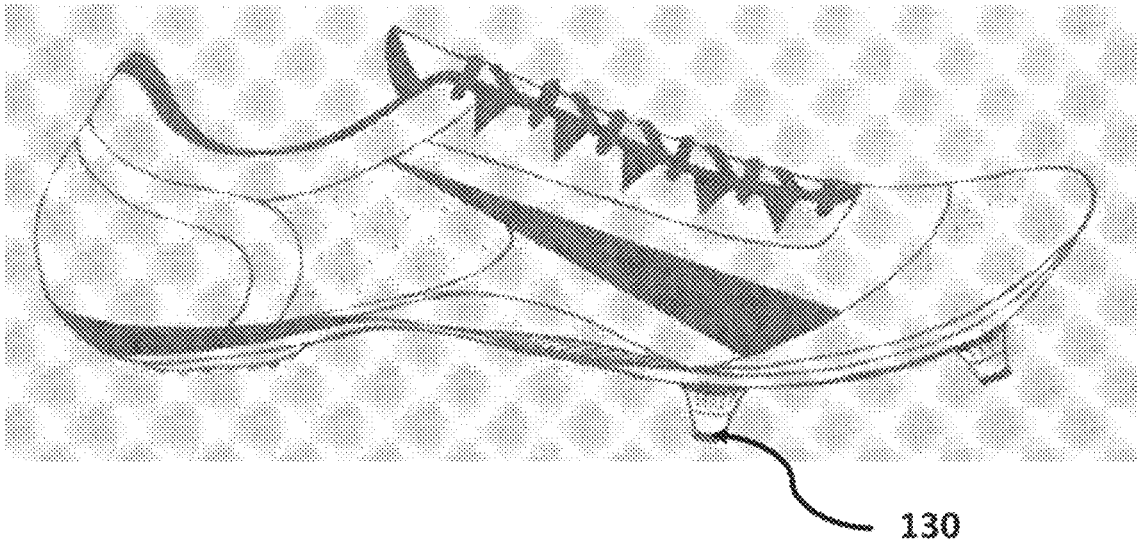
FIG. 16 is sporting footwear in accordance with another preferred embodiment of the present invention.
Figure 17:
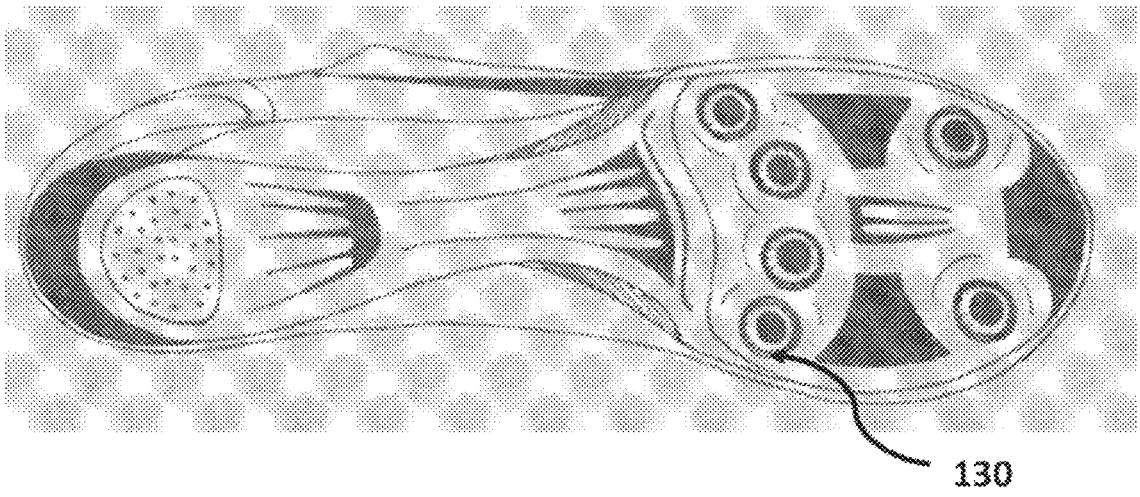
FIG. 17 is an underneath plan view of the sporting footwear of FIG. 16.
Figure 18:
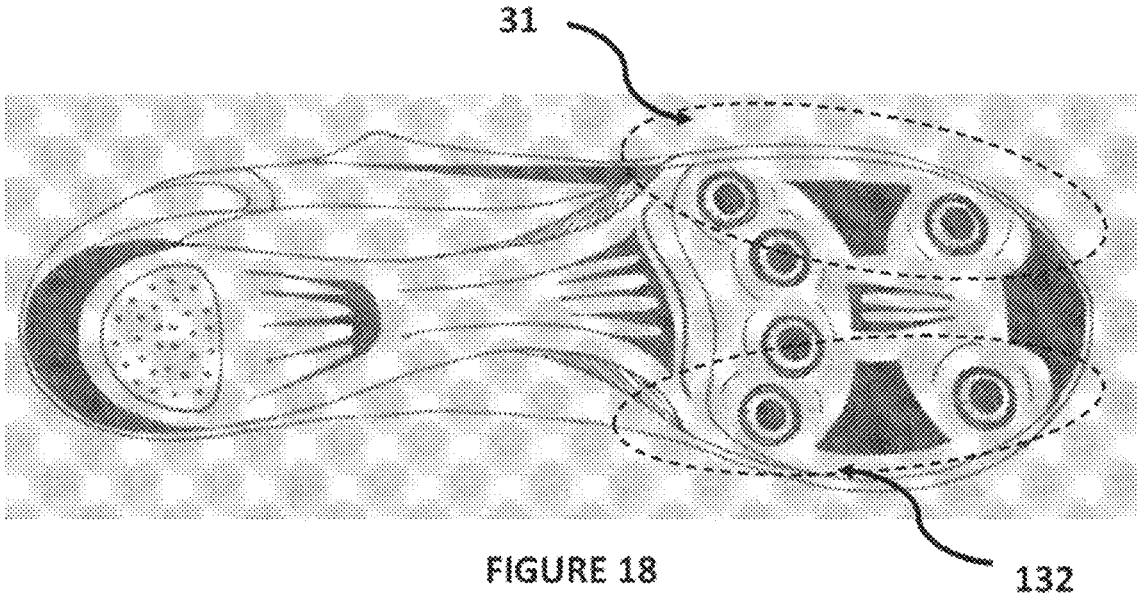
FIGS. 18, 19, and 20 are underneath plan views of the sporting footwear of FIG. 16 showing particular sections of the front sole.
Figure 19:
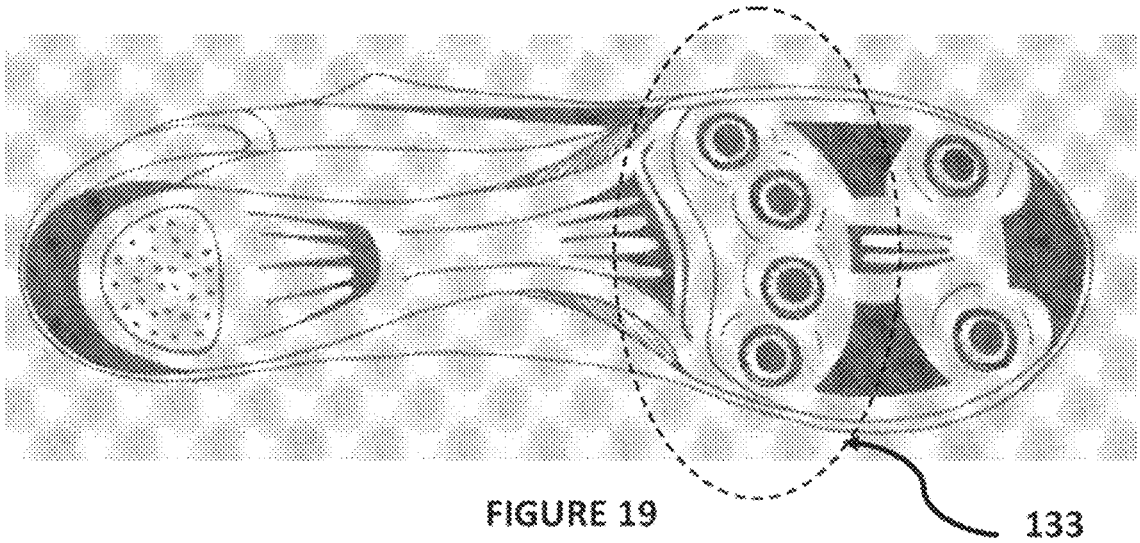
Figure 20:
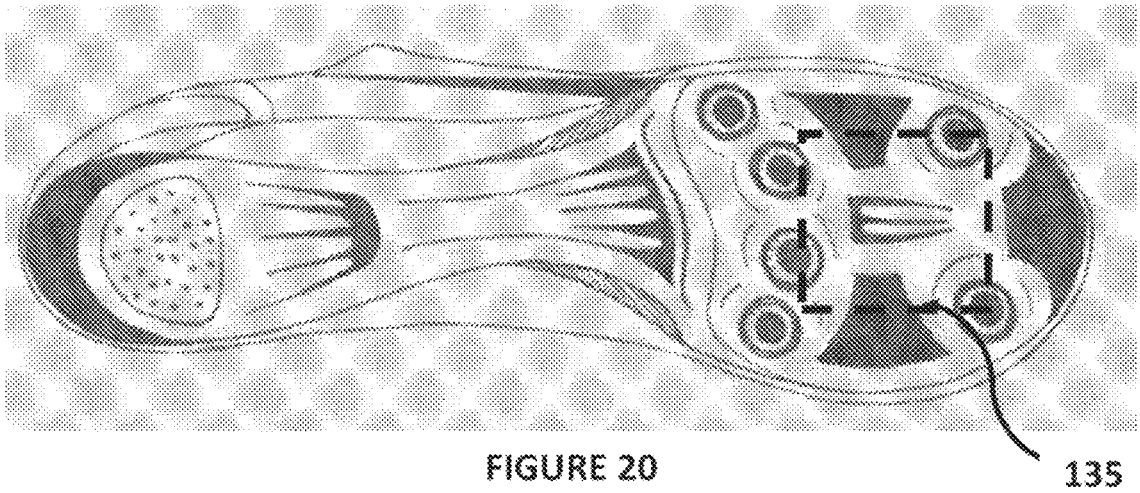

Variations of the relative lean of all of the inward leaning rear and side faces 45, 46 and 47 are shown in FIG. 10 and will be further explained.

Referring to the drawings of FIGS. 11 to 20, there is shown a further form of an embodiment of football boot 111 according to the invention having an upper 116 extending from a toe portion 117 to a heel portion 118 closeable by laces 119 in a top section. In the under surface there is a front sole plate 125 extending to a middle instep or arch support area 122 and to a rear heel section 123.

In the front sole plate 125 there are a plurality of sockets each for receiving a protrudable stop 130 providing the primary front frictional support sole.

In a form of the invention there includes a football boot having improved primary front foot support with improved longitudinal and lateral control such that only front of foot is primarily ground engaging to provide frictional control. This can be achieved in which a football boot has a rear heel 127 design with roll or stability characteristics but not with frictional characteristics such that only front of foot is primarily ground engaging to provide frictional control while rear of boot is aiding correct movement whether laterally or longitudinally.

The football boot 111 has improved primary front foot support with improved longitudinal and lateral control such that only front of foot is primarily ground engaging to provide frictional control. The front sole plate 125 has a plurality of sockets each for receiving a protrudable stop 130 providing the primary front frictional support sole.

However to more particularly improve lateral movement the sporting footwear has at least some of the plurality of sockets each for receiving a protrudable stop form substantially opposing lines near lateral edges of the sole plate and form substantially opposing lines 131, 132 near lateral edges of the sole plate 125.

In order to provide superior stoppability and control a majority of the plurality of sockets each for receiving a protrudable stop are located at the rear 133 of the front sole plate 125.

To more particularly improve pivotability on the front of the boot the rear heel has no protrusions and therefore no friction with the ground. Further at least one of the plurality of sockets each for receiving a protrudable stop is locatable in a central position 135 of the front sole plate 125 spaced from other stops to form a rotating pivot point.

The football boot 111 has rear heel design 127 with roll or stability characteristics but not with frictional characteristics such that only front of foot is primarily ground engaging to provide frictional control while rear of boot is aiding correct movement laterally or longitudinally. The heel 127 is a moulded continuous heel. The heel has little or no protrusions. More particularly the boot 111 is flexible to angle the heel 121 relative to the front sole 125. In this way a football boot requires only a primary front sole frictional support by use of stops or the like.

It can be seen that there are a number of elements that separately and together in various combinations provide:

a) Front emphasis of primary frictional support b) Lesser emphasis of secondary frictional support c) Cleat Design d) Stop Arrangement A sporting footwear according to the invention has a sole and heel with the sole having a primary frictional support and the heel having a secondary frictional support which has substantially less frictional support than the primary frictional support.

Front Emphasis of Primary Frictional Support

The invention provides a football boot having improved primary front foot support with improved longitudinal and lateral control such that only front of foot is primarily ground engaging to provide frictional control.

The front emphasis of primary frictional support is achieved through use of one or more of:

- a sporting footwear having stops only on the sole forming part of the primary frictional support and not on the heel having a secondary frictional support;
- having stops and cleats projecting from the sole and heel of the footwear and wherein the stops are only on the sole forming part of the primary frictional support and not on the heel having a secondary frictional support;
- the stops are substantially frusto-conical projections;
- the cleats are smaller projections than the stops;
- The weight of the footwear is towards the front; and/or
- The angle of the front sole to the rear heel provides the front emphasis of primary frictional support;

The footwear shown in FIGS. 1 to 6 has stops and cleats projecting from the sole and heel of the footwear. However the stops are only on the sole forming part of the primary frictional support and not on the heel having a secondary frictional support wherein the stops are receivable in receiving screw in slots.

A football boot can have improved pivot front foot support with improved longitudinal and lateral control such that only front of foot is primarily ground engaging to provide frictional control. An improved pivot front foot support includes stops on the front sole.

The sole having the primary frictional support is at an angle to the heel having the secondary frictional support which has substantially less frictional support than the primary frictional support such that only front of foot is primarily ground engaging to provide frictional control. The normal non flexed angle of the heel with the secondary frictional support to the sole with the primary frictional support is about 30° to 45°. The angle of the heel with the secondary frictional support to the sole with the primary frictional support flexes between about 0° to about the non-flexed angle. The angle of the heel with the secondary frictional support to the sole with the primary frictional support resiliently flexes back to the non-flexed angle.

Lesser Emphasis of Secondary Frictional Support

The lesser emphasis of secondary frictional support on the heel rather than the front sole of the footwear can be achieved by combination of one or more of:

a) No protrusions on the heel and protrusions on the front sole
b) Smaller protrusions on the rear heel to protrusions on the front sole
c) Patterned moulding on the heel to protrusions on the front sole
d) Smaller cleats only on the heel to larger stops only on the front sole
e) Smaller cleats only on the heel to larger stops and cleats on the front sole It can be seen that an important part of the design is the relative frictional support. By relative frictional support it is understood that this is related to the provision of ant-slip or lessening slip when the footwear hits the ground. Generally you wish to have control when playing sporting games with control of when and what to slip and when and what to not to slip (anti-slip).

The benefit of this lesser emphasis of secondary frictional support is that the heel is generally spaced from the front sole by the inner step or archway that is generally not ground engaging as it is a bridge following the inner arch of the wearer's foot. This results in a spacing and prior art footwear generally had a range of similar frictional support on both the spaced heel and sole. If a person lands prior art footwear at an angle to the straight ahead direction they will be stopped on that angle due to the similar frictional support and this will likely cause strain and stress on the wearer's leg and foot and ankle and knee at strange angels dramatically increasing chances of injury.

However with present invention the front emphasis of primary frictional support and the lesser emphasis of secondary frictional support means that the normal pivoting or front control of the foot is able to be used in the field of football and related sports.

It can be seen that if a wearer lands the improved footwear they will not have their foot twisted by the spaced frictional support but will have the primary frictional support undertaken by the sole and the secondary support providing secondary assistance.

That secondary assistance can then be focussed into the times you have both front sole and heel being ground engaging such as providing a solid base of the supporting leg to the ground while the other leg is swung above the ground to contact and kick the football. Thereby the stability and lateral anti-slide characteristics of both the primary frictional support of the front sole and the secondary frictional support of the heel become important.

It can be understood though that the secondary frictional support can have a substantially minimal friction support without protrusions if the wearer and sport require front support only and front pivoting only throughout all facets of the game.

Cleats

The cleats have a range of important elements and the cleats of the proposed invention can be any one or more of:

a) Relative sizing to the stops;
b) Mouldable protrusions;
c) Shaped protrusions;
d) Location of cleats;
e) Direction of shaped cleats; and/or
f) Relative width, length and/or height of cleats;

The cleats 41 are generally shaped projections having a leading front and a broader rear. In FIG. 7 there is shown a triangular prismatic shaped projections having a leading front and a broader rear with inward leaning rear and side faces 45, 46, 47. The cleats project about less than 60% of the projection of the stops to form smaller projections than the stops. However more preferably the cleats project about 50% of the projection of the stops to form smaller projections than the stops. In one example the cleats project about 7.5 millimetres while the stops project about 15.0 millimetres.

The cleats are generally arranged on the front sole to have the broader rear of the shaped projections facing forward on the footwear so as to aid stopping actions by the primary frictional support. Therefore the primary frictional surface is improved by the directional arrangement of the cleat with the rear plane 45 of the cleat facing forward. This cleat rear wall 45 can be inclined higher towards a 90° plane by shortening the length S2 and lengthening S1 for a particular length L of shaped cleat. Preferably the cleat rear wall is partially inclined so as to not instantly catch the ground but to provide a controlled element of slide then grip. The incline and particularly the triangular pyramidal shape provides a flow over of the ground and a directional control of the slide in line with the vertex of the two inward leaning side planes 46, 47.

The cleats on or near the circumference of the heel are generally arranged the rear heel to have the narrower front of the shaped projections facing forwardly towards a region or point on the instep on the footwear. The cleats are generally arranged on the front sole to have the narrower front of the shaped projections facing rearwardly towards a region or point on the instep on the footwear.

This arrangement of the direction of the rear plane 47 of the cleat thereby provides a definable support of the footwear so that the heel provides a backwards anti-slide so that the foot will not slide backwards when the wearer is kicking with the other foot. Also this arrangement of the direction of the rear plane 47 of the cleat on the front sole thereby provides a definable support of the footwear so that the front sole provides a frontwards anti-slide or controlled slide to stop so that the foot will not continue to slide forwards when the wearer is trying to stop.

However other alterations to this cleat design can apply such as to increase the angle such as shown in FIG. 10 where the entire length L of the cleat is increased relative to the width W.

The inward leaning rear and side faces are substantially planar. In order to minimise contact injuries with other players the intersection of the inward leaning side faces are rounded or the intersection of the inward leaning side faces are beaded. Another option is to have the intersection of the inward leaning side faces are chamfered.

Referring to FIG. 7 another adjustment is the relative leaning of the outer cleat wall 46 to the inner cleat wall 47. The inward leaning rear and side faces are shaped and located on the sole or heel such that the outer leaning wall leans less inwardly than the inner leaning wall. That is the outer leaning wall 46 is closer to 90° rather than the inner leaning wall 47. When there is to be a balance then the inward leaning rear and side faces 46, 47 are shaped and located on the sole or heel such that if the cleat is centrally located on the sole or heel the outer leaning wall leans substantially equally to the inner leaning wall.

Stop Arrangement

The stop arrangement can provide a number of benefits.

The first benefit is that by only having stops on the front sole of the footwear and not on the heel then there is a direct emphasis of frictional importance to the front of the footwear. Further the density and relative protrusion to any other protrusion on For the benefit of pivoting a football boot includes stops on the front sole and includes no stops or substantial protrusions on the rear sole relative to the front sole. In this way there is no substantial heel protrusion to become entangled in the football pitch and allows the wearer to pivot on the front.

This pivot can be further emphasised by having a primary stop in a central portion of the front sole. This can be provided by at least one of the plurality of sockets for receiving a protrudable stop being locatable in a central position of the front sole plate spaced from other stops to form a rotating pivot point. However the pivot stop could be moulded to the sole plate.

Also preferably at least some of the plurality of stops are in location in substantially opposing lines near lateral edges of the sole. Still further a majority of the plurality of sockets each for receiving a protrudable stop are located at the rear of the front sole.

The football boot has rear heel design with roll or stability characteristics but not with frictional characteristics such that only front of foot is primarily ground engaging to provide frictional control while rear of boot is aiding correct movement laterally or longitudinally. Preferably the heel is a moulded continuous heel, with little or no protrusions.

Interpretation

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks.

Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the sports shoe and sporting industries.

The claims defining the invention are as follows:

1. A sporting footwear, comprising a football boot for use on grass, the footwear having a sole and a heel, with the sole having a primary frictional support and the heel having a secondary frictional support, wherein the primary frictional support is angled to the secondary frictional support such that only the sole of the boot is primarily ground engaging to provide frictional control, a plurality of long substantially broad frustoconical protrusions forming stops projecting from the sole of the footwear and a plurality of short substantially triangular pyramidal shaped projections forming cleats projecting from the sole and the heel of the footwear, wherein the cleats project away from the sole of the footwear a smaller distance than the stops, and wherein the stops are only on the sole and not on the heel, the stops and cleats on the sole forming the secondary frictional support and the heel has only cleats forming the secondary frictional support, the secondary frictional supports having less frictional support compared to the primary frictional support, wherein the cleats are triangular prismatic shaped projections having three substantially planar sides forming a leading end and a broader end opposite the leading end with inward leaning faces on each substantially planar side, wherein the orientation of the cleats changes according to their location on the sole or the heel whereby the cleats being arranged on the sole to have the leading end facing rearward on the footwear so as to aid stopping actions by the primary frictional support, and wherein the cleats are arranged on the heel to have the leading end facing forward on the footwear to aid frontwards sliding motion by the secondary frictional support, and whereby the footwear has improved primary front foot support with improved longitudinal and lateral control with the sole having the primary frictional support being at an angle to the heel such that only a front of a foot is primarily ground engaging to provide frictional control.

2. A sporting footwear according to claim 1 wherein the cleats are smaller projections than the stops such that the cleats project about less than 60% of the projection of the stops to form smaller projections than the stops.

3. A sporting footwear according to claim 1 wherein the cleats project about 7.5 millimetres and the stops project about 15.0 millimetres.

4. A sporting footwear according to claim 1 wherein the sole having the primary frictional support is at an angle to the heel having the secondary frictional support which has substantially less frictional support than the primary frictional support such that only front of foot is primarily ground engaging to provide frictional control wherein a normal non-flexed angle of the heel with the secondary frictional support to the sole with the primary frictional support is about 30° to 45° and wherein the angle of the heel with the secondary frictional support to the sole with the primary frictional support flexes substantially between about 0° to about the non-flexed angle.

5. A sporting footwear according to claim 1 wherein the angle of the heel with the secondary frictional support to the sole with the primary frictional support resiliently flexes back to a non-flexed angle.

6. A sporting footwear according to claim 1 wherein the stops are substantially frusto-conical projections.

7. A sporting footwear according to claim 1 wherein the cleats are generally arranged on the sole to have the leading end of the shaped projections facing rearwardly towards a region or point on an instep on the footwear.

8. A sporting footwear according to claim 1 wherein the cleats on or near the circumference of the heel are generally arranged the heel to have the leading end of the shaped projections facing forwardly towards a region or point on an instep on the footwear.

9. A sporting footwear according to claim 1 wherein the cleats are generally arranged on the front sole to have the leading end of the shaped projections facing rearwardly towards a region or point on an instep on the footwear.

10. A sporting footwear according to claim 1 wherein the inward leaning rear and side faces of the cleats are shaped and located on the sole or heel such that the outer leaning wall leans less inwardly than the inner leaning wall and wherein the inward leaning rear and side faces are shaped and located on the sole or heel such that if the cleat is centrally located on the sole or heel the outer leaning wall leans substantially equally to the inner leaning wall.

11. A sporting footwear according to claim 1 wherein the stops are receivable in receiving screw in slots.

12. A sporting footwear according to claim 1 wherein the cleats are mouldable with the heel or sole.

13. A sporting footwear according to claim 1 wherein the stops are mouldable with the front sole.

14. A sporting footwear according to claim 1 further comprising a football boot having improved pivot front foot support with improved longitudinal and lateral control such that only front of foot is primarily ground engaging to provide frictional control.

15. A sporting footwear according to claim 1 wherein at least some of the plurality of stops in location form substantially opposing lines near lateral edges of the sole plate.

16. A sporting footwear having:

a. a sole and heel i. with the sole having a primary frictional support and the heel having a secondary frictional support, wherein the primary frictional support is angled to the secondary frictional support such that only the sole of the boot is primaril ground engaging to provide frictional control b. stops and cleats projecting from the heel of the footwear and cleats projecting from the sole and heel of the footwear, i. wherein the stops are only on the sole and not on the heel, the stops and cleats on the sole forming the primary frictional support, the cleats on the heel forming the secondary frictional support having less frictional support compared to the primary frictional support; and ii. wherein the cleats project away from the sole a smaller distance than the stops; and c. the sole having the primary frictional support at an angle to the heel such that only front of foot is primarily ground engaging to provide frictional control d. wherein the cleats are triangular prismatic shaped projections having three substantially planar sides forming a leading end and a broader end opposite the leading end with an inward leaning rear face and inward leaning side faces e. and wherein the orientation of the cleats changes according to their location on the sole or the heel, whereby the cleats are generally arranged on the sole to have the broader end of the shaped projections facing forward on the footwear so as to aid stopping actions by the primary frictional support, and the cleats are generally arranged on the rear heel to have the leading end of the shaped projections facing forward on the footwear so as to aid frontwards sliding motion by the secondary frictional support.

17. A sporting footwear according to claim 16 wherein:

a. the inward leaning rear face and the inward leaning side faces are shaped and located on the sole or heel such that an outer inward leaning side face leans less wardly than an inner leaning side face; and b. the inward leaning rear face and the inward leaning side faces are shaped and located on the sole or heel such that if the cleat is centrally located on the sole or heel the outer inward leaning side face leans substantially equally to the inner inward leaning side face.

* * * * *